US005325617A

United States Patent [19]

Vojta et al.

[11] Patent Number: 5,325,617

[45] Date of Patent: Jul. 5, 1994

[54] SYSTEM FOR CHANGING THE BARREL OF A GUN OR WEAPON

[76] Inventors: Maximilian Vojta; Franz Gabriel, both of Wiesengasse 159, A-2551 Enzesfeld, Austria

[21] Appl. No.: 669,607

[22] Filed: Mar. 14, 1991

[30] Foreign Application Priority Data

Mar. 15, 1990 [AT] Austria ..... 618/90

[51] Int. Cl.[5] ..... F41A 21/48

[52] U.S. Cl. ..... 42/75.03; 42/77; 89/14.3; 89/191.02; 89/196

[58] Field of Search ..... 42/71.02, 75.03, 77; 89/14.3, 163, 191.02, 196

[56] References Cited

U.S. PATENT DOCUMENTS

| | | | |
|---|---|---|---|
| 1,138,376 | 5/1915 | Hammond | 89/191.02 |
| 2,898,693 | 8/1959 | Ruger | 89/196 |
| 4,207,799 | 6/1980 | Tocco | 89/196 |

FOREIGN PATENT DOCUMENTS

| | | | |
|---|---|---|---|
| 421613 | 11/1925 | Fed. Rep. of Germany | 89/191.02 |
| 1394566 | 2/1965 | France | 89/196 |
| 17029 | 4/1916 | United Kingdom | 89/196 |

OTHER PUBLICATIONS

Cooper, Jeff, "Pistol Action", Guns & Ammo, May 1973, pp. 38-39, 85.

Metcalf, Dick, "Ram-Line's Syn-Tech Semiauto .22 Pistol" Shooting Times, Mar. 1990, pp. 48-57.

Clark Custom Guns, Inc.

*Primary Examiner*—Stephen C. Bentley

*Attorney, Agent, or Firm*—Kenyon & Kenyon

[57] ABSTRACT

A system for changing the barrel of a firearm includes a firearm that has a stock having a trigger mounted thereon and a housing part removably attached to the stock in a fixed operative position. The housing part has a sighting mechanism on its upper side. A barrel is mounted in the housing part and a breech block is disposed in the housing part, which travels rearward on firing and cooperates with a locking system mounted in the housing part. A closing spring surrounds the barrel and means are provided for connecting the closing spring to the breech block. A firing pin is reciprocally received within the breech block. Also provided is means for removably retaining the barrel, closing spring, breech block, connecting means, and locking system within the housing part. A releasable key means, which holds the housing part in the fixed operative position, has a release position to remove the housing part in a direction substantially transverse thereto. The barrel, closing spring, breech block, connecting means, and locking system are retained within the housing part in operative positions with respect to each other, and the housing part is held in fixed position with respect to the stock.

17 Claims, 5 Drawing Sheets

VI
VI

SYSTEM FOR CHANGING THE BARREL OF A GUN OR WEAPON

BACKGROUND OF THE INVENTION

The invention pertains to a system for changing the barrel of a firearm which has a barrel, a breech block, a locking system, a breech closing spring, a trigger system, a firing pin, a stock and a sighting mechanism, in particular for a pistol or automatic pistol.

Systems for changing the barrel of a firearm, especially a weapon used for competition or sport, are already known and are used to mount barrels of differing length, different caliber or inside profile to the standard firearm.

Also known is the mounting of a compensator at the barrel muzzle that uses the energy of the powder gas to compensate for the recoil and jump of the weapon when firing. Normally the compensator is subsequently mounted securely to the weapon's barrel, and thus the firearm is adapted with considerable effort to the desired end needs of the user. These systems thus have the disadvantage that it is practically impossible for the user to equip a weapon with different types of compensator.

Systems are also known where the compensator is mounted with a type of bayonet lock and secured against loosening by a spring-loaded plunger, but the compensator is attached to the breech slides and thus after each shot moves telescope-like with respect to the barrel—this is undesirable.

In any case, the inventor knows of no system with which the barrel and compensator of a firearm can be readily replaced by the user.

The goal of the invention is to create a system for changing the barrel of a firearm with which the user can easily replace the barrel with a few simple hand operations and thus can select a barrel whose length, caliber, and internal profile are chosen according to the particular needs of the user.

Another goal of the invention is to create a system with which not only the barrel of the weapon, but also the compensator can be easily and simply replaced and adapted to the particular, used barrel, or the firearm equipped with this barrel, so that finally, a firearm can be assembled that has optimum properties for the user.

SUMMARY OF THE INVENTION

These goals are achieved by a system of the type described above, since per the invention, the barrel, the breech block, the locking system, the breech closing spring and the firing pin are mounted in a separate part of the housing provided with the sighting mechanism and with it form a fireable assembly that is mounted to the standard firearm having stock and trigger system in a predetermined rigid, but detachable, relative position.

In this manner the invention creates a system for a firearm, especially a pistol, where the barrel including breech block, locking system, breech closing spring and firing pin are assembled in a common housing into a fireable assembly that as a whole can be removed from the handle provided with trigger system and can be checked for operability. The barrel can be readily removed from the housing part and replaced by another. The housing part is provided with a standard sighting mechanism.

The locking system can be rigid, semirigid or controlled by the pressure of the powder gas, or can be formed by a simple spring-stock breech.

A considerable advantage of the invention is that when firing, the barrel does not move so that there are no problems resulting from repetition.

A favorable refinement of the invention of a firearm with gas-pressure controlled locking system having a gas-pressure-impacted spring guide bushing acting on the breech block, is characterized in that both the spring guide bushing and also the breech closing spring are located around the barrel and that the breech closing spring is braced against the spring guide bushing. In this manner a slender and low housing is achieved.

It is also an advantage if the interior space of the housing part is of cylindrical design and the barrel, breech block, locking system, breech closing spring and firing pin in the housing part are secured by means of a slide moving transverse to it in the housing part and contacting the barrel. Thus an extremely simple dismantling and assembly of the replaceable barrel are achieved.

It is useful if the barrel is provided on its outside with a groove running perpendicular to its longitudinal axis, said groove meshing with the slide. In this way the barrel is secured in the axial direction of the weapon.

In a favorable design of the invention, the housing part is set along a plane onto the stock of the standard firearm, in an end region of the breech area equipped with protrusions extending into depressions in the stock, and has a locking unit at a distance from the protrusions that detachably locks with another locking unit provided on the stock. This gives a simple, but accurate method of preparation and easy assembly of the weapon components.

The locking unit located on the housing part can have at least one transverse, groove-shaped, back-cut depression and the locking unit provided on the stock has a key bolt rotary seated on a transverse axis, said key bolt is bounded by two parallel, planar surfaces and by two cylindrical surfaces. This yields an easy to operate and yet highly reliable locking unit that takes up little space in the weapon.

Another favorable design of the invention is characterized by the fact that at the housing part, at its end corresponding to the barrel muzzle, a compensator or a housing extension is detachably mounted in a specified, relative position and that the muzzle end of the barrel is tightly seated in the compensator or in the housing extension.

This version of the invention allows the user not only to adapt the barrel of the weapon to his needs, but also to select the best compensator for the particular barrel. Thus the invention creates a mechanical assembly system that allows the user to obtain a firearm with different properties with no outside help and without tools, at any site and in the shortest time with consistent, standard components, like a stock including trigger system, housing part, breech block and locking system, by replacement of the barrel and/or compensator, said properties will ensure the best firing accuracy under the most diverse circumstances. An important effect of this version of the invention is that the weight of the compensator has no effect on repeat firing because the barrel does not move. In the case of a housing extension, it is also possible to mount the bead of the sighting mechanism on the housing extension and in this manner to achieve a longer line of sight.

The compensator or housing extension can be provided in a known manner with a cylindrical attachment with a radial protruding hub and the housing part with a cylindrical depression to hold the set, in which a bayonet breech depression is formed, and provided with a spring-loaded snap pin sliding parallel to the longitudinal axis of the housing part; said snap pin at rest extends into an opening of the compensator or housing extension. This simplifies replacement of the compensator if the user is familiar with the hand operations for other compensators (e.g. U.S. Pat. No. 4,207,799) needed for this.

In a particularly favorable design, guide paths parallel to the barrel are formed on the breech and their ends touch stops located on the stock when the breech is open. This action serves to limit the maximum movement of the breech block.

Finally, in another variant of the invention, a joint is formed at a predetermined location on the barrel; said joint is used as a stop for the spring guide bushing with the assembly removed from the stock. In a functional test of the assembly removed from the stock, this property prevents the breech block from being pulled out of the housing part.

BRIEF DESCRIPTION OF THE DRAWINGS

The invention will be explained below with reference to a preferred sample design that is illustrated schematically in the figures. We see.

DETAILED DESCRIPTION

Figure 1:
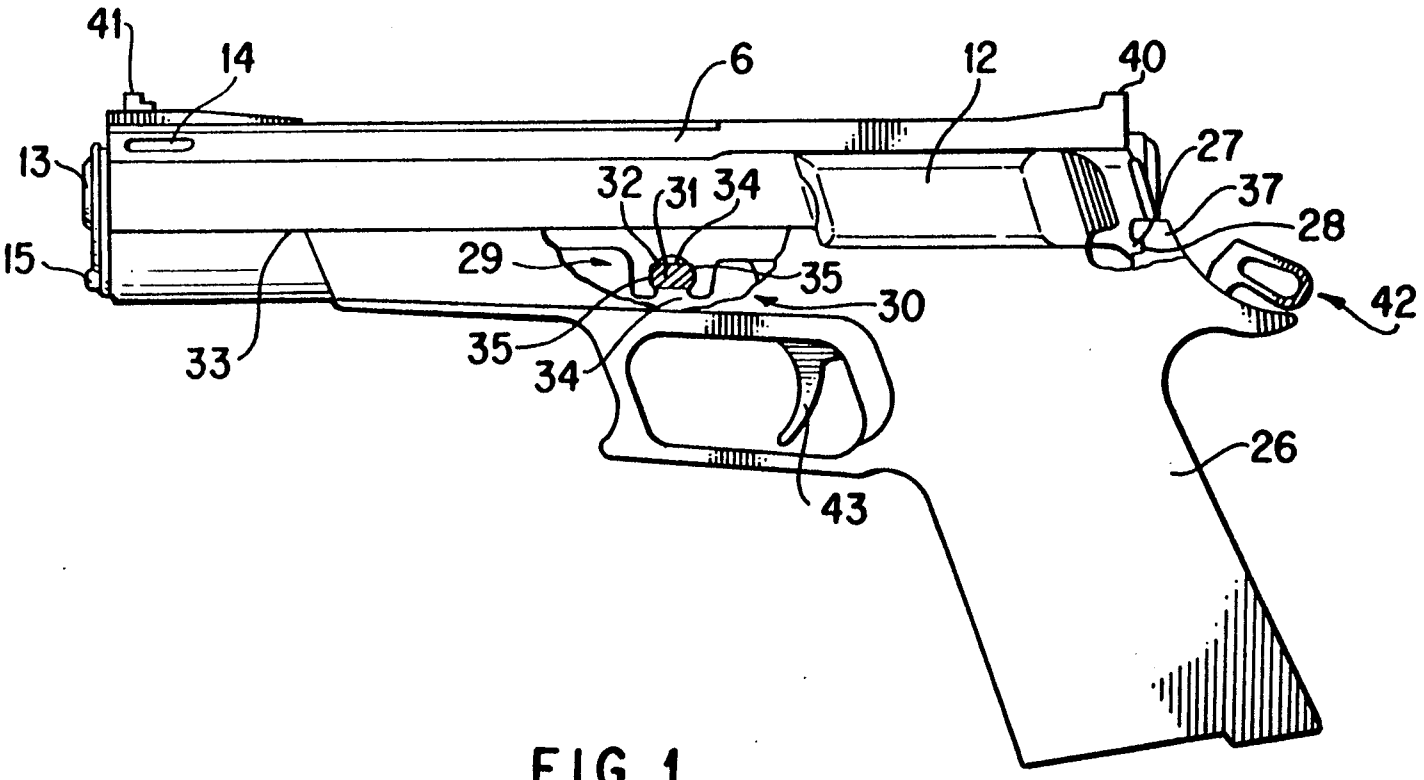
FIG. 1: A side view of an assembled pistol, partial cut away to illustrate the connection of components to the stock

FIG. 1 shows schematically a pistol equipped with the invented system, where said component is removed from the stock (26) of the pistol. A trigger system (42) is installed in the usual manner in stock (26); only the firing pin and trigger (43) are shown. On stock (26) there is a housing part (6) along its plane (33), its outer shape is similar to that of the breech slide of a conventional pistol. However, housing part (6) a stock (26) are joined in a predetermined, relative position, for which purpose the stock (26) has on its back side forward-opening depressions (28) into which backward-pointing protrusions (27) formed on the back side of housing part (6), mesh. On the other side, above trigger (43) on stock (26), a locking unit (30) is provided that coordinates with a locking unit (29) present on housing part (6).

Locking unit (30) of stock (26) consists of a rotary seated key bolt (31) turning about an axis running transverse to the longitudinal axis of the pistol. Said key bolt is bounded by two opposing, planar surfaces (34) and two opposing cylindrical surfaces (35) and can be turned by means of a pivot lever (dashed lines in the figure). Key bolt (31) meshes into a locking unit (29) at the underside of housing part (6), that consists of two (shown one in front of the other in the figure), transverse, groove-shaped, back-cut depressions (32) of essentially cylindrical shape, where normally the cylindrical surfaces (35) of key bolt (31) contact the walls of depressions (32). By pivoting the pivot lever, key bolt (31) is turned until it can exit the depressions (32) (see FIG. 8).

The housing part (6) has on its top side a sighting mechanism consisting of a notch (40) and bead (41). In the front region of housing part (6) on its top side there are two leads (14) for removal of powder gas. In addition, in the front region of housing part (6), a compensator (13) is installed and is secured by a snap pin (15) as explained below. The leads (14) through housing part (6) align With corresponding leads in compensator (13) (see FIG. 5).

Figure 2:
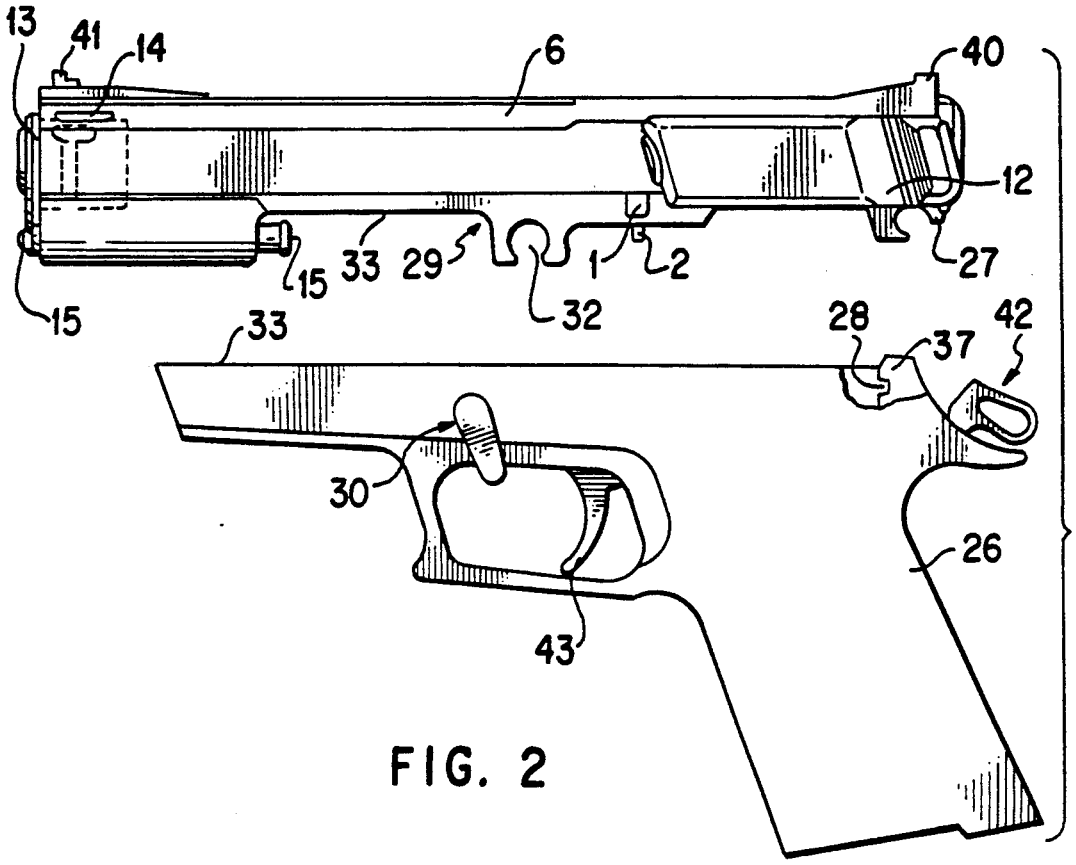
FIG. 2: The stock and the pistol component removed from it, side view

FIG. 2 shows a stock (26) and the assembly removed from it (side view). The compensator (13) installed in the housing part (6) is shown by dashed lines where it is evident how the leads in the compensator (13) align with the leads (14) in the housing part (6). The snap pin (15) is seated in a downward protruding section of the housing part (6), its length shifts and it is tensioned forward by a (not shown) spring.

Figure 3:
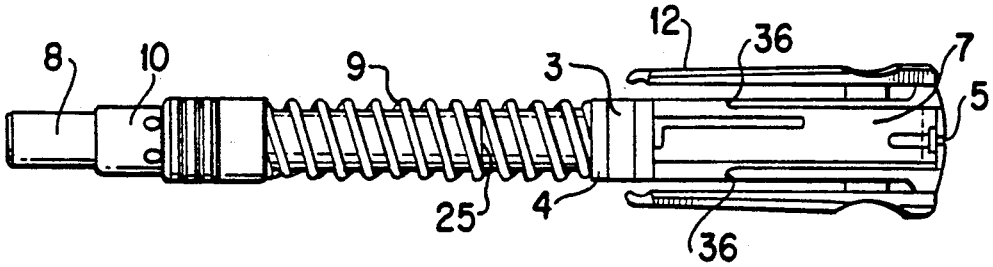
FIG. 3: A bottom view of the components removed from the housing part.

FIG. 3 is a bottom view of the barrel (8) of the pistol on which its breech closing spring (9) is sitting; at the breech end it is braced against a joint (4) and at the muzzle end, against a spring guide bushing (10) that in this case is designed as a gas plunger of a gas-pressure controlled locking system. At the rear side of joint (4) there is a breech block (7) in which the firing pin (5) is seated and which is provided with a cocking slide (12). Perpendicular to the axis of barrel (8) a groove with rectangular cross section runs over joint (4). On the side of groove (3) pointing to the barrel muzzle, joint (4) is slanted off as explained below.

Figures 4, 5, 6:
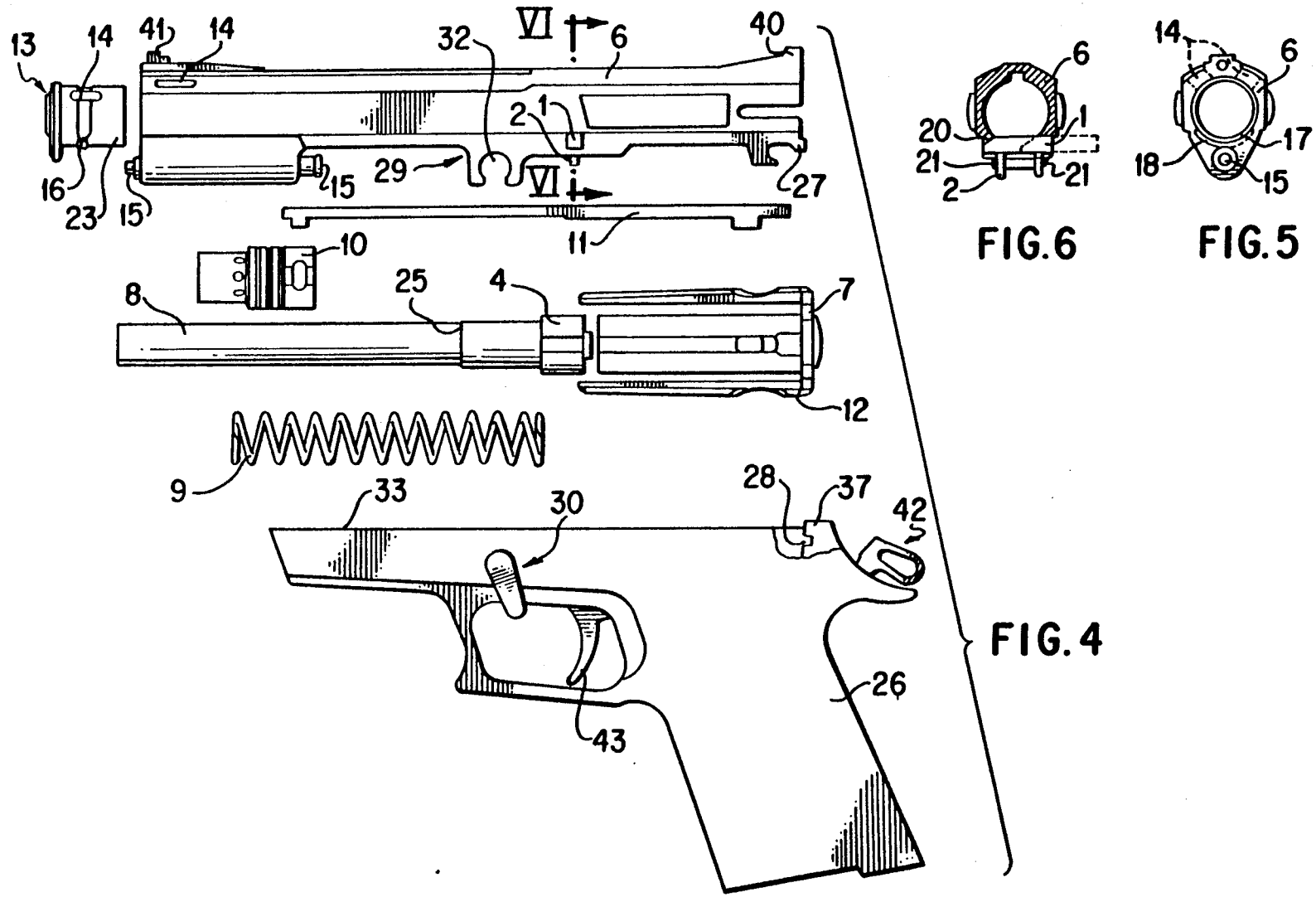
FIG. 4: A side view of the pistol broken down into its main component parts.
FIG. 5: A front view of the housing part
FIG. 6: A cut away along line VI—VI in FIG. 4

FIG. 4 shows the essential components of the pistol equipped with the invented system (side view), but where breech (7), barrel (8) and spring guide bushing (10) are shown in top view. On the assembled pistol, breech block (7) is joined with the spring guide bushing (10) (or the gas plunger) via a tie rod (11) whose protrusion at each end fits into a corresponding cutout in breech (7) or in the spring guide bushing (10).

As we see in FIGS. 2, 4 and 6, on the underside of housing part (6) in the region of the breech-side barrel end, there is a slide (1) located perpendicular to the longitudinal axis; said slide bears a pin (2) extending downward. Slide (1) has essentially the same cross section as groove (3) in joint (4) of barrel (8). In the assembled state of the unit, slide (1) rests in groove (3) of barrel (8) and thus secures the barrel (8) with breech (7), breech block closing spring (9), spring guide bushing (10) and tie rod (11) in housing part (6) against sliding in the longitudinal direction.

FIG. 6 also shows that the inside space of housing part (6) is of cylindrical design and has a channel on the upper side, said channel is used to hold the tie rod (11). If the barrel (8) is to be changed, then slide (1) is pushed aside from its normal position (shown by solid lines) into the removal position (shown by dashed lines). The movement of slide (1) is limited by side stops (21) where pin (2) stops in the two named positions. The interior end of slide (1) in the removal position is provided with a slanting cut (20) corresponding to the slanting cut of joint (4). In the removal position, slide (1) lies entirely outside of groove (3), so that by pulling back the cocking slide (12), all components placed in housing part (6) can be pulled out of it to the rear (see also FIG. 7).

Figure 7:
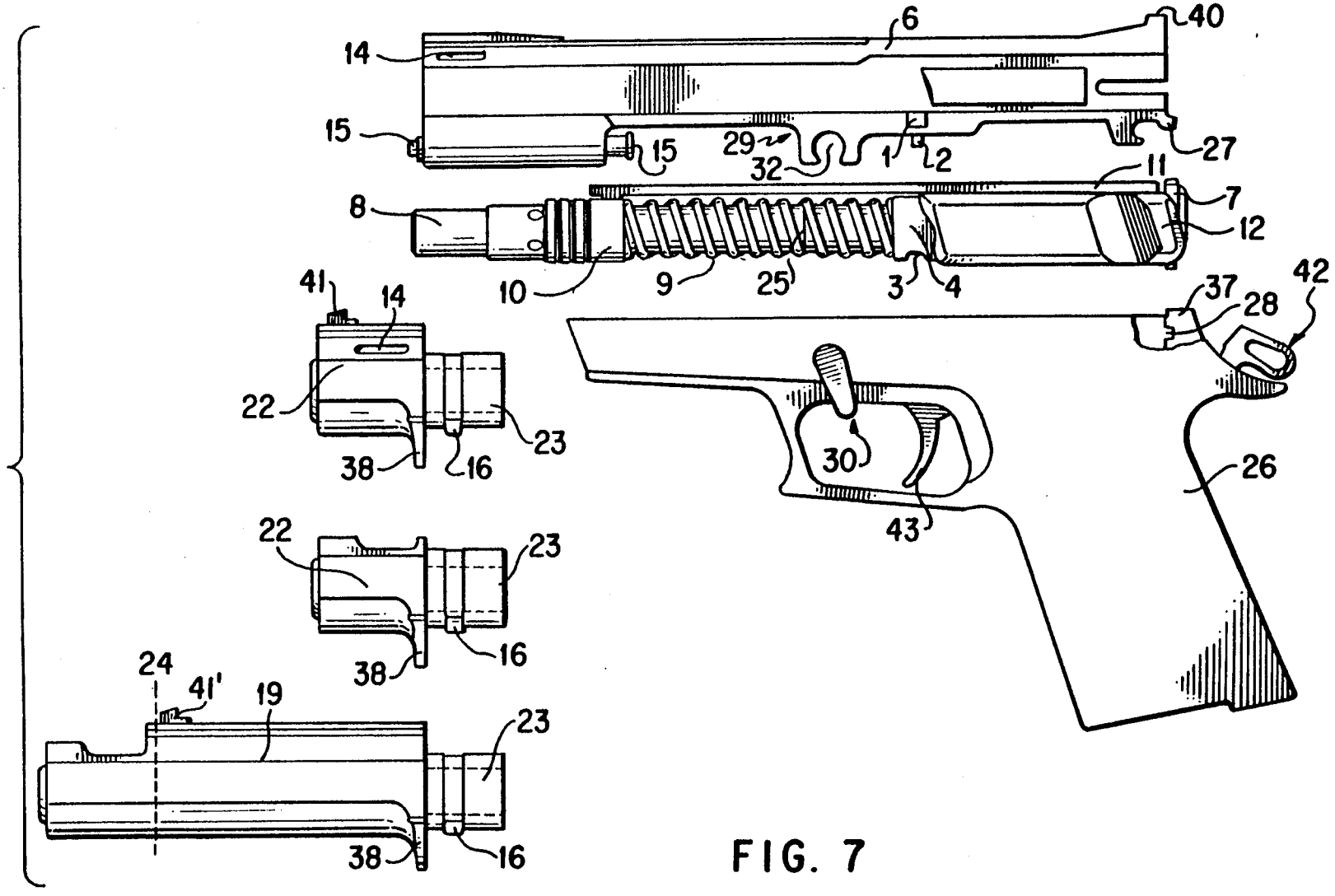
FIG. 7: A view similar to FIG. 4, including various compensators and a housing extension.

After removal of tie rod (11), the breech block (7) is free and the spring guide bushing (10) and also the breech spring (9) can be removed and pushed onto another barrel (not shown). After setting on the breech block (7), the spring guide bushing (10) is pushed backward under compression of the breech closing spring (9) until the tie rod (11) can be suspended (FIG. 7). The thus combined components are then pushed from back to front in housing part (6) and are fixed therein by sliding slide (1) back into its normal position.

Barrel (8) is mounted tightly in compensator (13) on one side by its joint (4) in housing part (6) and on its other side by its muzzle end section.

The assembly put together in this manner is already functional arid ready to fire. One can insert a cartridge into breech (7) and fire it by striking firing pin (5) with a suitable tool.

When assembled, the rearward motion of breech block (7) is limited by two longitudinal-running guide paths (36) (FIG. 3) whose front ends coordinate with stops (37) formed on stock (26).

However, it is often desirable to check the assembly after replacing the barrel (8) and before attachment to the stock (26) to determine its operability, by pulling back cocking slide (12). In order to avoid removing breech block (7) from housing part (6), because with the assembly removed from stock (26) the stops (37) are ineffective, a second joint (25) is formed on the barrel (8) at a specified distance from joint (4); said joint (25) does extend over the breech closing spring (9), but the spring guide bushing (10) strikes against it when it is pulled backward via tie rod (11).

FIGS. 4 and 5 show how compensator (13) is attached to housing part (6). Housing part (6) has a cylindrical depression on its front side that preferably has the same inside diameter as the cylindrical interior space of housing part (6). At a small distance from the free end of housing part (6), groove (17) running along a part of the circumference is formed in the wall of the depression; a forward-opening depression (18) joins said groove to create a bayonet breech cutout.

Compensator (13) has a cylindrical attachment (23) with a radial protruding hub (16) located at a distance from flange (38) that corresponds to the distance of groove (17) from the free end of housing part (6). The hub is first inserted axially into depression (18) of housing part (6) and then into groove (17) by turning of compensator (13). Flange (38) is provided on its underside with a circular notch in which snap pin (15) fits when compensator (13) is in its operating position.

FIG. 7 shows the stock (26) of the firearm in side view, with housing part (6) and components removed from it, namely breech (7) together with cocking slide (12), breech closing spring (9), spring guide bushing (10) and tie rod (11). Also, FIG. 7 shows two different compensators (22) and a housing extension (19) that can be attached to housing part (6) instead of the compensator (22). For this purpose, housing extension (19) is designed just like compensator (22) with an attachment (23), a hub (16) and a flange (38). Perhaps it is also provided with a notch (41') for the sighting mechanism in order to create a longer line of sight.

Preferably housing extension (19) is formed on the front side as a type of compensator. Naturally the housing extension (19) has a length sufficient to extend the associated barrel up to line (24). This barrel can be tightly seated in the housing extension (19) either in the region of attachment (23) or in the region of line (24). In other words, housing extension (19) represents a long compensator whose length is adapted to the associated, longer barrel.

Figure 8:
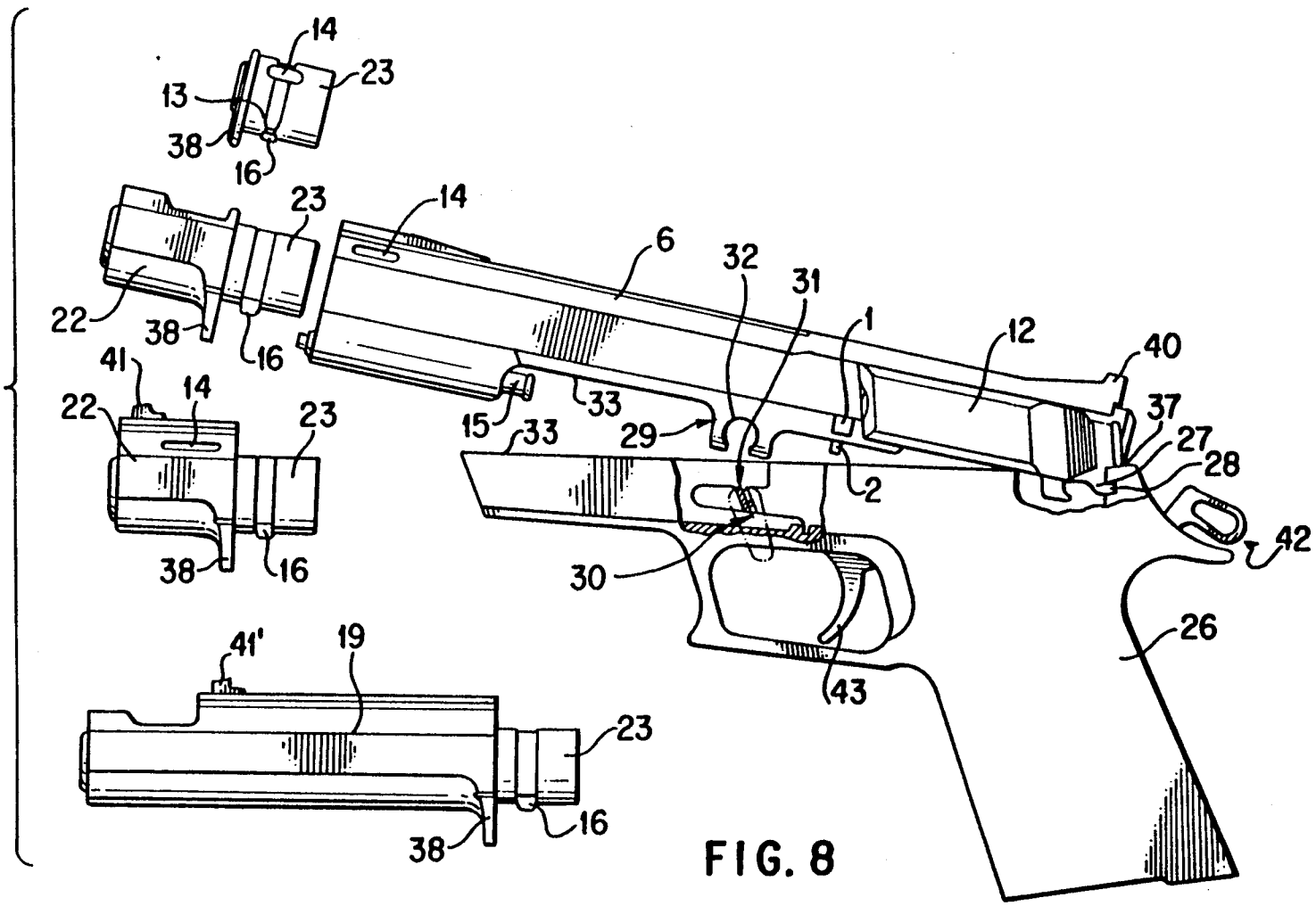
FIG. 8: A side view of the assembly partly set onto the stock, partly a cut away view to illustrate the breech components, and side views of several compensators and one housing extension.

FIG. 8 is a representation similar to FIG. 7 and shows how the assembly is joined to stock (26). First, protrusions (27) of housing part (6) are set into depressions (28) of stock (26) and then the unit is pivoted down around protrusions (27) until housing part (6) sits on stock (26) along plane (33). Now key bolt (31) sits in depressions (32) of the locking unit (29) and is turned into its position shown in FIG. 1 where housing part (6) is securely locked to stock (26).

As explained, the movement of breech block (7) while firing is limited by the impact of the ends of guide paths (36) on stops (37). On the other hand the movement of breech block (7) is limited in a functional check of the assembly, by impact of spring guide bushing (10) against joint (25). The latter motion is slightly larger than the former, so a play exists between spring guide bushing (10) and joint (25) that mostly relieves the tie rods (11) from stress pulses during the reversal in motion of breech block (7).

A technician will see that numerous modifications are possible within the framework of the invention and that the invention is not restricted to the described and illustrated sample designs.

We claim:

1. A system for changing the barrel of a firearm, said firearm comprising: a stock having a trigger mounted thereon; a housing part removably attached to said stock in a fixed operative position, said housing part having a sighting mechanism on its upper side; a barrel mounted in the housing part; a breech block disposed in the housing part which travels rearward on firing; a locking system mounted in the housing part cooperating with said breech block; a closing spring surrounding the barrel; means for connecting the closing spring to the breech block; a firing pin reciprocally received within the breech block; means for removably retaining said barrel, closing spring, breech block, connecting means, and locking system within said housing part; a releasable key means for holding said housing part in the fixed operative position, said releasable key means having a release position to remove the housing part in a direction substantially transverse thereto, said barrel, closing spring, breech block, connecting means, and locking system being retained within the housing part in operative positions with respect to each other, said housing part being held in fixed position with respect to the stock; wherein said housing part has an interior space of cylindrical design and further comprising a slide securing the barrel, breech, locking system, breech closing spring and firing pin in the housing part, said slide sliding transverse in the housing part and contacting the barrel such that the barrel can be easily removed from the housing part and replaced with another barrel.

2. The system per claim 1, further comprising a groove provided on the outside of the barrel, said groove running perpendicular to the longitudinal axis of the barrel, said groove meshing with the slide.

3. A system for changing the barrel of a firearm, said firearm comprising: a stock having a trigger mounted thereon; a housing part removably attached to said stock in a fixed operative position, said housing part having a sighting mechanism on its upper side; a barrel mounted in the housing part; a breech block disposed in the housing part which travels rearward on firing; a locking system mounted in the housing part cooperating with said breech block; a closing spring surrounding the barrel; means for connecting the closing spring to the breech block; a firing pin reciprocally received within the breech block; means for removably retaining said barrel, closing spring, breech block, connecting means, and locking system within said housing part; a releasable key means for holding said housing part in the fixed operative position, said releasable key means having a release position to remove the housing part in a direction substantially transverse thereto, said barrel, closing spring, breech block, connecting means, and locking system being retained within the housing part in operative positions with respect to each other, said housing part being held in fixed position with respect to the stock; wherein said housing part is positioned along a plane onto the stock in an end region of the breech block, said housing part having protrusions extending into depressions in the stock and a locking unit disposed at a distance from the protrusions which detachably locks with another locking unit provided on the stock.

4. The system per claim 3, wherein said locking unit located on the housing part has at least one transverse, groove-shaped, back-cut depression and the locking unit provided on the stock has a key bolt rotary seated on a transverse axis, said key bolt being bounded by two parallel, planar surfaces and by two cylindrical surfaces.

5. A system for changing the barrel of a firearm, said firearm comprising: a stock having a trigger mounted thereon; a housing part removably attached to said stock in a fixed operative position, said housing part having a sighting mechanism on its upper side; a barrel mounted in the housing part; a breech block disposed in the housing part which travels rearward on firing; a locking system mounted in the housing part cooperating with said breech block; a closing spring surrounding the barrel; means for connecting the closing spring to the breech block; a firing pin reciprocally received within the breech block; means for removably retaining said barrel, closing spring, breech block, connecting means, and locking system within said housing part; a releasable key means for holding said housing part in the fixed operative position, said releasable key means having a release position to remove the housing part in a direction substantially transverse thereto, said barrel, closing spring, breech block, connecting means, and locking system being retained within the housing part in operative positions with respect to each other, said housing part being held in fixed position with respect to the stock; wherein the system further comprises guide paths extending parallel to the barrel formed on the breech, said guide paths having ends that touch stops located on the stock when the breech is open.

6. A system for changing the barrel of a firearm, said firearm comprising: a stock having a trigger mounted thereon; a housing part removably attached to said stock in a fixed operative position, said housing part having a sighting mechanism on its upper side; a barrel having a muzzle end mounted in the housing part; a breech block disposed in the housing part which travels rearward on firing and cooperates with a gas-pressure controlled breech locking system mounted in the housing part, said locking system having a gas-pressure loaded spring guide bushing acting on the breech block and located around the barrel; a closing spring surrounding the barrel and braced against the spring guide bushing; means for connecting the closing spring to the breech block; a firing pin reciprocally received within the breech block; means for removably retaining said barrel, closing spring, breech block, connecting means, and locking system within said housing part; a releasable key means for holding said housing part in the fixed operative position, said releasable key means having a release position to remove the housing part in a direction substantially transverse thereto, said barrel, closing spring, breech block, connecting means, and locking system being retained within the housing part in operative positions with respect to each other, said housing part being held in fixed position with respect to the stock; a compensator detachably mounted in a preset relative position on an end of the housing part corresponding to the barrel muzzle, said muzzle end of the barrel being tightly seated in the compensator without clearance; wherein said housing part has an interior that is cylindrical and further comprising a slide securing the barrel, breech, locking system, breech closing spring and firing pin, said slide contacting the barrel and sliding transverse thereto in the housing part such that the barrel can be easily removed from the housing part and replaced with another one.

7. The system per claim 6, further comprising a groove provided on the outside of the barrel, said groove extending perpendicular to the longitudinal axis of the barrel into which the slide fits.

8. A system for changing the barrel of a firearm, said firearm comprising: a stock having a trigger mounted thereon; a housing part removably attached to said stock in a fixed operative position, said housing part having a sighting mechanism on its upper side; a barrel having a muzzle end mounted in the housing part; a breech block disposed in the housing part which travels rearward on firing and cooperates with a gas-pressure controlled breech locking system mounted in the housing part, said locking system having a gas-pressure loaded spring guide bushing acting on the breech block and located around the barrel; a closing spring surrounding the barrel and braced against the spring guide bushing; means for connecting the closing spring to the breech block; a firing pin reciprocally received within the breech block; means for removably retaining said barrel, closing spring, breech block, connecting means, and locking system within said housing part; a releasable key means for holding said housing part in the fixed operative position, said releasable key means having a release position to remove the housing part in a direction substantially transverse thereto, said barrel, closing spring, breech block, connecting means, and locking system being retained within the housing part in operative positions with respect to each other, said housing part being held in fixed position with respect to the stock; a compensator detachably mounted in a preset relative position on an end of the housing part corresponding to the barrel muzzle, said muzzle end of the barrel being tightly seated in the compensator without clearance; wherein said housing part is positioned onto the stock of the other firearm along a plane in a breech-side end region, said housing part having protrusions that fit into depressions in the stock and further having a locking unit located at a distance to the protrusions that is detachably locked to another locking unit provided on the stock.

9. The system per claim 8, wherein said locking unit located on the housing part has at least one transverse, groove-like, back-cut depression and said locking unit provided on the stock has a key bolt rotary seated on a transverse axis, said key bolt being bounded by two parallel, flat surfaces and by two cylindrical surfaces.

10. A system for changing the barrel of a firearm, said firearm comprising: a stock having a trigger mounted thereon; a housing part removably attached to said stock in a fixed operative position, said housing part having a sighting mechanism on its upper side; a barrel having a muzzle end mounted in the housing part; a breech block disposed in the housing part which travels rearward on firing and cooperates with a gas-pressure controlled breech locking system mounted in the housing part, said locking system having a gas-pressure loaded spring guide bushing acting on the breech block and located around the barrel; a closing spring surrounding the barrel and braced against the spring guide bushing; means for connecting the closing spring to the breech block; a firing pin reciprocally received within the breech block; means for removably retaining said barrel, closing spring, breech block, connecting means, and locking system within said housing part; a releasable key means for holding said housing part in the fixed operative position, said releasable key means having a release position to remove the housing part in a direction substantially transverse thereto, said barrel, closing spring, breech block, connecting means, and locking system being retained within the housing part in operative positions with respect to each other, said housing part being held in fixed position with respect to the stock; a compensator detachably mounted in a preset relative position on an end of the housing part corresponding to the barrel muzzle, said muzzle end of the barrel being tightly seated in the compensator without clearance; wherein the system further comprises guide paths extending parallel to the barrel formed on the breech, said guide paths having ends contact stops located at the stock when the breech is opened.

11. A system for changing the barrel of a firearm, said firearm comprising: a stock having a trigger mounted thereon; a housing part removably attached to said stock in a fixed operative position, said housing part having a sighting mechanism on its upper side; a barrel mounted in the housing part; a breech block disposed in the housing part which travels rearward on firing; a locking system mounted in the housing part cooperating with said breech block; a closing spring surrounding the barrel; means for connecting the closing spring to the breech block; a firing pin reciprocally received within the breech block; means for removably retaining said barrel, closing spring, breech block, connecting means, and locking system within said housing part; a releasable key means for holding said housing part in the fixed operative position, said releasable key means having a release position to remove the housing part in a direction substantially transverse thereto, said barrel, closing spring, breech block, connecting means, and locking system being retained within the housing part in operative positions with respect to each other, said housing part being held in fixed position with respect to the stock; wherein said locking system comprises a gas-pressure controlled locking system having a gas-pressure-impacted spring guide bushing acting on the breech, said spring guide bushing and said breech closing spring being located around the barrel, and said breech closing spring being braced against the spring guide bushing; and wherein said housing part is positioned along a plane onto the stock in an end region of the breech block, said housing part having protrusions extending into depressions in the stock and a locking unit disposed at a distance from the protrusions which detachably locks with another locking unit provided on the stock.

12. A system for changing the barrel of a firearm, said firearm comprising: a stock having a trigger mounted thereon; a housing part removably attached to said stock in a fixed operative position, said housing part having a sighting mechanism on its upper side; a barrel mounted in the housing part; a breech block disposed in the housing part which travels rearward on firing; a locking system mounted in the housing part cooperating with said breech block; a closing spring surrounding the barrel; means for connecting the closing spring to the breech block; a firing pin reciprocally received within the breech block; means for removably retaining said barrel, closing spring, breech block, connecting means, and locking system within said housing part; a releasable key means for holding said housing part in the fixed operative position, said releasable key means having a release position to remove the housing part in a direction substantially transverse thereto, said barrel, closing spring, breech block, connecting means, and locking system being retained within the housing part in operative positions with respect to each other, said housing part being held in fixed position with respect to the stock; wherein said locking system comprises a gas-pressure controlled locking system having a gas-pressure-impacted spring guide bushing acting on the breech, said spring guide bushing and said breech closing spring being located around the barrel, and said breech closing spring being braced against the spring guide bushing; and wherein said system further comprises guide paths extending parallel to the barrel formed on the breech, said guide paths having ends that touch stops located on the stock when the breech is open.

13. A system for changing the barrel of a firearm, said firearm comprising: a stock having a trigger mounted thereon; a housing part removably attached to said stock in a fixed operative position, said housing part having a sighting mechanism on its upper side; a barrel having a muzzle end mounted in the housing part; a breech block disposed in the housing part which travels rearward on firing and cooperates with a gas-pressure controlled breech locking system mounted in the housing part, said locking system having a gas-pressure loaded spring guide bushing acting on the breech block and located around the barrel; a closing spring surrounding the barrel and braced against the spring guide bushing; means for connecting the closing spring to the breech block; a firing pin reciprocally received within the breech block; means for removably retaining said barrel, closing spring, breech block, connecting means, and locking system within said housing part; a releasable key means for holding said housing part in the fixed operative position, said releasable key means having a release position to remove the housing part in a direction substantially transverse thereto, said barrel, closing spring, breech block, connecting means, and locking system being retained within the housing part in operative positions with respect to each other, said housing part being held in fixed position with respect to the stock; a compensator detachably mounted in a preset relative position on an end of the housing part corresponding to the barrel muzzle, said muzzle end of the barrel being tightly seated in the compensator without clearance; wherein the compensator has a cylindrical attachment with a radial protruding hub and the housing part has a cylindrical depression to hold the set in which a bayonet breech depression is formed, and further comprising a spring-loaded snap pin sliding parallel to the longitudinal axis of the housing part, said snap pin fitting in an opening of the compensator when at rest; and wherein said housing part has an interior that is cylindrical and further comprising a slide securing the barrel, breech, locking system, breech closing spring and firing pin, said slide contacting the barrel and sliding transverse thereto in the housing part such that the barrel can be easily removed from the housing part and replaced with another one.

14. A system for changing the barrel of a firearm, said firearm comprising: a stock having a trigger mounted thereon; a housing part removably attached to said stock in a fixed operative position, said housing part having a sighting mechanism on its upper side; a barrel having a muzzle end mounted in the housing part; a breech block disposed in the housing part which travels rearward on firing and cooperates with a gas-pressure controlled breech locking system mounted in the housing part, said locking system having a gas-pressure loaded spring guide bushing acting on the breech block and located around the barrel; a closing spring surrounding the barrel and braced against the spring guide bushing; means for connecting the closing spring to the breech block; a firing pin reciprocally received within the breech block; means for removably retaining said barrel, closing spring, breech block, connecting means, and locking system within said housing part; a releasable key means for holding said housing part in the fixed operative position, said releasable key means having a release position to remove the housing part in a direction substantially transverse thereto, said barrel, closing spring, breech block, connecting means, and locking system being retained within the housing part in operative positions with respect to each other, said housing part being held in fixed position with respect to the stock; a compensator detachably mounted in a preset relative position on an end of the housing part corresponding to the barrel muzzle, said muzzle end of the barrel being tightly seated in the compensator without clearance; wherein the compensator has a cylindrical attachment with a radial protruding hub and the housing part has a cylindrical depression to hold the set in which a bayonet breech depression is formed, and further comprising a spring-loaded snap pin sliding parallel to the longitudinal axis of the housing part, said snap pin fitting in an opening of the compensator when at rest; and wherein said housing part is positioned onto the stock of the other firearm along a plane in a breech-side end region, said housing part having protrusions that fit into depressions in the stock and further having a locking unit located at a distance to the protrusions that is detachably locked to another locking unit provided on the stock.

15. A system for changing the barrel of a firearm, said firearm comprising: a stock having a trigger mounted thereon; a housing part removably attached to said stock in a fixed operative position, said housing part having a sighting mechanism on its upper side; a barrel having a muzzle end mounted in the housing part; a breech block disposed in the housing part which travels rearward on firing and cooperates with a gas-pressure controlled breech locking system mounted in the housing part, said locking system having a gas-pressure loaded spring guide bushing acting on the breech block and located around the barrel; a closing spring surrounding the barrel and braced against the spring guide bushing; means for connecting the closing spring to the breech block; a firing pin reciprocally received within the breech block; means for removably retaining said barrel, closing spring, breech block, connecting means, and locking system within said housing part; a releasable key means for holding said housing part in the fixed operative position, said releasable key means having a release position to remove the housing part in a direction substantially transverse thereto, said barrel, closing spring, breech block, connecting means, and locking system being retained within the housing part in operative positions with respect to each other, said housing part being held in fixed position with respect to the stock; a compensator detachably mounted in a preset relative position on an end of the housing part corresponding to the barrel muzzle, said muzzle end of the barrel being tightly seated in the compensator without clearance; wherein the compensator has a cylindrical attachment with a radial protruding hub and the housing part has a cylindrical depression to hold the set in which a bayonet breech depression is formed, and further comprising a spring-loaded snap pin sliding parallel to the longitudinal axis of the housing part, said snap pin fitting in an opening of the compensator when at rest; and wherein the system further comprises guide paths extending parallel to the barrel formed on the breech, said guide paths having ends contact stops located at the stock when the breech is opened.

16. A system for changing the barrel of a firearm, said firearm comprising: a stock having a trigger mounted thereon; a housing part removably attached to said stock in a fixed operative position, said housing part having a sighting mechanism on its upper side; a barrel mounted in the housing part; a breech block disposed in the housing part which travels rearward on firing; a locking system mounted in the housing part cooperating with said breech block; a closing spring surrounding the barrel; means for connecting the closing spring to the breech block; a firing pin reciprocally received within the breech block; means for removably retaining said barrel, closing spring, breech block, connecting means, and locking system within said housing part; a releasable key means for holding said housing part in the fixed operative position, said releasable key means having a release position to remove the housing part in a direction substantially transverse thereto, said barrel, closing spring, breech block, connecting means, and locking system being retained within the housing part in operative positions with respect to each other, said housing part being held in fixed position with respect to the stock; wherein said locking system comprises a gas-pressure controlled locking system having a gas-pressure-impacted spring guide bushing acting on the breech, said spring guide bushing and said breech closing spring being located around the barrel, and said breech closing spring being braced against the spring guide bushing; and wherein said housing part has an interior space of cylindrical design and further comprising a slide securing the barrel, breech, locking system, breech closing spring and firing pin in the housing part, said slide sliding transverse in the housing part and contacting the barrel such that the barrel can be easily removed from the housing part and replaced with another barrel.

17. The system per claim 16, further comprising a groove provided on the outside of the barrel, said groove running perpendicular to the longitudinal axis of the barrel, said groove meshing with the slide.

* * * * *